US010043442B2

(12) United States Patent
Hsu

(10) Patent No.: US 10,043,442 B2
(45) Date of Patent: Aug. 7, 2018

(54) DISPLAY DEVICE, AND METHOD FOR MODIFYING IMAGE DISPLAYING ON THE DISPLAY DEVICE

(71) Applicant: EVERDISPLAY OPTRONICS (SHANGHAI) LIMITED, Shanghai (CN)

(72) Inventor: Jung-Chung Hsu, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 158 days.

(21) Appl. No.: 15/149,726

(22) Filed: May 9, 2016

(65) Prior Publication Data

US 2017/0124940 A1 May 4, 2017

(30) Foreign Application Priority Data

Oct. 29, 2015 (CN) ..... 2015 1 0724077

(51) Int. Cl.
*G09G 5/02* (2006.01)
*G09G 3/3208* (2016.01)

(52) U.S. Cl.
CPC ... *G09G 3/3208* (2013.01); *G09G 2300/0452* (2013.01); *G09G 2320/0626* (2013.01)

(58) Field of Classification Search
CPC ..... G09G 3/3208; G09G 2300/0452; G09G 2320/0626
See application file for complete search history.

(56) References Cited

U.S. PATENT DOCUMENTS 8,063,913 B2 * 11/2011 Choe ..... G06T 5/008 345/611
9,830,858 B2 * 11/2017 Seo ..... G09G 3/3233
2007/0035557 A1 * 2/2007 Choe ..... G06T 5/008 345/613
2008/0204393 A1 * 8/2008 Ben-David ..... G09G 3/007 345/98
2009/0289963 A1 * 11/2009 Minami ..... G09G 3/3233 345/690
2016/0155416 A1 * 6/2016 Lee ..... G09G 3/2003 345/690
2017/0004751 A1 * 1/2017 Seo ..... G09G 3/3233
2017/0053582 A1 * 2/2017 Hsu ..... G06T 5/003
2017/0116900 A1 * 4/2017 Chaji ..... G09G 3/2003
2017/0178554 A1 * 6/2017 Xiao ..... G09G 3/2074

* cited by examiner

*Primary Examiner* — Peter D McLoone
(74) *Attorney, Agent, or Firm* — Yunling Ren

(57) ABSTRACT

The present disclosure relates to a display device and a method for modifying image displaying on a display panel. The display panel includes a pixel array composed of a plurality of pixel points each including three subpixels of three different colors which are arranged in a delta arrangement. The method includes: receiving original image signals which include brightness values of respective subpixels; determining a plurality of first pixel points; for each subpixel in each of the first pixel points, modifying the brightness value of the subpixel according to the brightness value of a subpixel having the same color as the subpixel in at least one of pixel points which are adjacent to the first pixel point; and providing the pixel array with modified image signals according to the modified brightness values of respective subpixels in the first pixel points.

17 Claims, 8 Drawing Sheets

DISPLAY DEVICE, AND METHOD FOR MODIFYING IMAGE DISPLAYING ON THE DISPLAY DEVICE

CROSS-REFERENCE TO RELATED APPLICATIONS

This application claims priority to Chinese Patent Application No. 201510724077.8, filed Oct. 29, 2015, the entire contents of which are incorporated herein by reference.

TECHNICAL FIELD

The present disclosure generally relates to display technologies, and more particularly to a display device and a method for modifying image displaying on a display panel.

BACKGROUND

Recently, Organic Light Emitting Diode (OLED) technology has gained rapid developments and become the most promising technology which may replace Liquid Crystal Displays (LCDs).

FIG. 1 shows a pixel array of an OLED display panel. The pixel array 100 includes a plurality of pixel points 110, each of which includes three subpixels 111 of three different colors which are arranged in a delta arrangement. When displaying images using such pixel array, the edge 200 of the displayed object will appear as unsmooth zigzags. In order to improve display effect, there are proposed the following two methods to reduce the zigzags which occur at edges of displayed objects.

FIG. 2 shows a first method: with a pixel point in the pixel array as a unit, the image signals to be displayed are filtered using a low pass filter so as to modify the brightness values of pixel points. This method can remove the zigzags at edges, and however, portions of the image where no zigzags occur become blurred because of filtering. Because the filtering is performed with a pixel point as a unit, the height D of the region at the edges of the displayed object where brightness values change gradiently is a total height of at least two pixel points, thereby resulting in blurring in edge portions of the object.

FIG. 3 shows a second method: the subpixels 111 which are in a region 300 which protrudes from the edges and has a relatively high brightness value are filtered using a low pass filter. However, such method needs to determine whether the subpixels 111 are located at edges of the object. Also, when the edges of the displayed object are white lines on a black background, such method will cause the white lines to become thinner. And when the edges of the displayed object are black lines on a white background, such method will cause the black lines to become thicker.

SUMMARY

Aiming at the defects in related arts, embodiments of the present disclosure provide a display device and a method for modifying image displaying on a display panel which can address zigzags in images displayed using a pixel array in a delta arrangement.

According to an aspect of embodiments of the present disclosure, there is provided a method for modifying image displaying on a display panel, wherein the display panel includes a pixel array composed of a plurality of pixel points each including three subpixels of three different colors which are arranged in a delta arrangement, wherein the method includes:

receiving original image signals which comprise brightness values of respective subpixels;

according to the original image signals, identifying edge pixel points of an object to be displayed on the display panel as the first pixel points;

for each subpixel in each of the first pixel points, modifying the brightness value of the subpixel according to the brightness value of a subpixel having the same color as the subpixel in at least one of pixel points which are adjacent to the first pixel point; and providing the pixel array with modified image signals according to the modified brightness values of respective subpixels in the first pixel points.

Optionally, the plurality of pixel points are arranged in a row direction and a column direction, and any two adjacent subpixels have different colors.

Optionally, for each subpixel in each of the first pixel points, the brightness value of the subpixel is modified according to the brightness value of a subpixel having the same color as the subpixel in at least one of pixel points which are adjacent to the first pixel point in the row and/or column direction.

Optionally, the method further includes:

modifying the brightness value of each subpixel in the first pixel points using a first brightness modifying method; or modifying the brightness value of each subpixel in the first pixel points using a second brightness modifying method; or for any two first pixel points which are adjacent with each other in the row direction, modifying the brightness value of each subpixel in one of the two pixel points using the first brightness modifying method, and modifying the brightness value of each subpixel in the other one of the two pixel points using the second brightness modifying method; and for any two first pixel points which are adjacent with each other in the column direction, modifying the brightness value of each subpixel in the two pixel points using the same brightness modifying method.

Optionally, the first brightness modifying method comprises:

for each subpixel having a first color in each of the first pixel points, modifying the brightness value of the subpixel having the first color according to the brightness value of a subpixel having the first color in one pixel point which is immediately above and adjacent to the first pixel point in the column direction and the brightness value of a subpixel having the first color in one pixel point which is at immediate left of and adjacent to the first pixel point in the row direction;

for each subpixel having a second color in each of the first pixel points, modifying the brightness value of the subpixel having the second color according to the brightness value of a subpixel having the second color in one pixel point which is immediately above and adjacent to the first pixel point in the column direction and the brightness value of a subpixel having the second color in one pixel point which is at immediate right of and adjacent to the first pixel point in the row direction; and for each subpixel having a third color in each of the first pixel points, modifying the brightness value of the subpixel having the third color according to the brightness value of a subpixel having the third color in one pixel point which is immediately below the first pixel point in the column direction.

Optionally, the second brightness modifying method comprises:

for each subpixel having a first color in each of the first pixel points, modifying the brightness value of the subpixel having the first color according to the brightness value of a subpixel having the first color in one pixel point which is immediately below and adjacent to the first pixel point in the column direction and the brightness value of a subpixel having the first color in one pixel point which is at immediate left of and adjacent to the first pixel point in the row direction;

for each subpixel having a second color in each of the first pixel points, modifying the brightness value of the subpixel having the second color according to the brightness value of a subpixel having the second color in one pixel point which is immediately below and adjacent to the first pixel point in the column direction and the brightness value of a subpixel having the second color in one pixel point which is at immediate right of and adjacent to the first pixel point in the row direction; and for each subpixel having a third color in each of the first pixel points, modifying the brightness value of the subpixel having the third color according to the brightness value of a subpixel having the third color in one pixel point which is immediately above the first pixel point in the column direction.

Optionally, the first color, the second color, and the third color are green, red, and blue, respectively; or the first color, the second color, and the third color are red, green, and blue, respectively.

Optionally, an area of each blue subpixel is greater than an area of either of each red subpixel and green subpixel.

Optionally, the brightness values of respective subpixels in the first pixel points are modified using a low pass filter.

According to another aspect of embodiments of the present disclosure, there is provided a display device, including:

a display panel, including a pixel array;

an image processing apparatus which modifies image displaying on the display panel using the method according to the above aspect.

Optionally, the display device is an OLED display device.

In the present disclosure, brightness values of subpixels are modified with a subpixel as a unit so as to eliminate the zigzags in images displayed using a pixel array in a delta arrangement. Meanwhile, the width of the region at edges of a displayed object where brightness values change gradiently can be reduced. If the edges of the object to be displayed are white lines on a black background or black lines on a white background, by modifying the brightness values of subpixels using the method provided by the present disclosure, the line widths will not change.

BRIEF DESCRIPTION OF THE DRAWINGS

The above and other features and advantages of the present disclosure will become clearer from the description of exemplary embodiments with reference to drawings.

DETAILED DESCRIPTION

Figure 1:
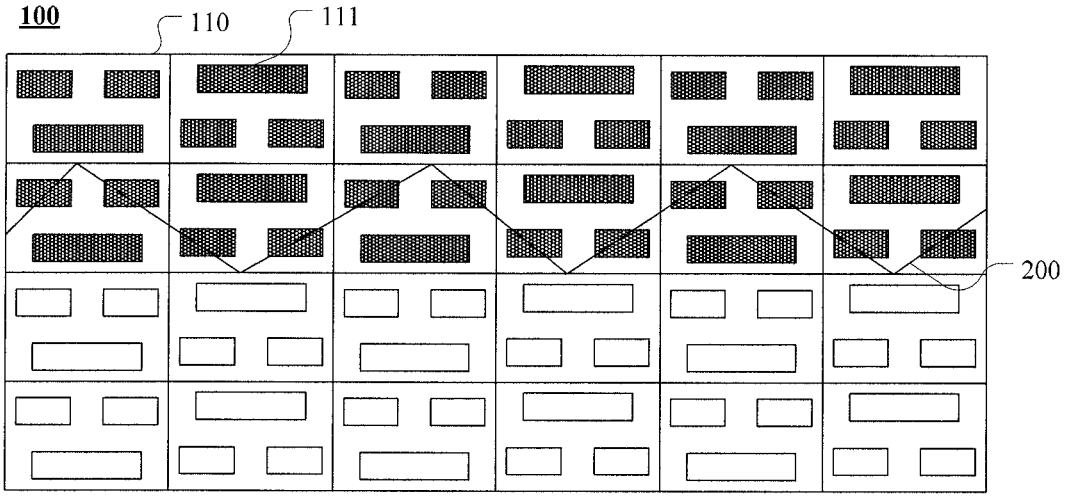
Fig. 1 (Prior Art)
FIG. 1 is a schematic diagram which shows displaying images using a pixel array in conventional technologies.
Figure 2:
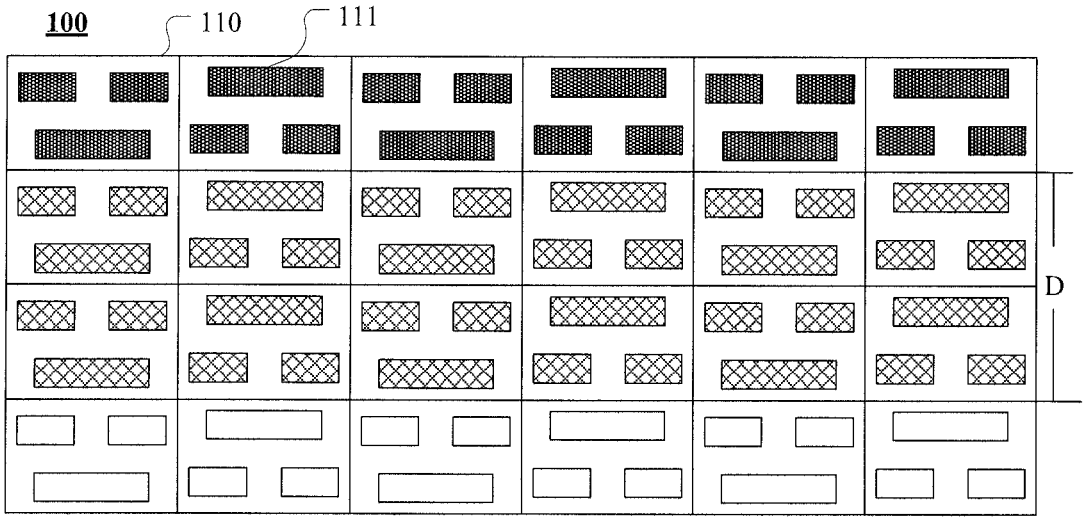
Fig. 2 (Prior Art)
FIG. 2 is a schematic diagram which shows displaying images after modifying brightness values of pixel points in a pixel array in conventional technologies.
Figure 3:
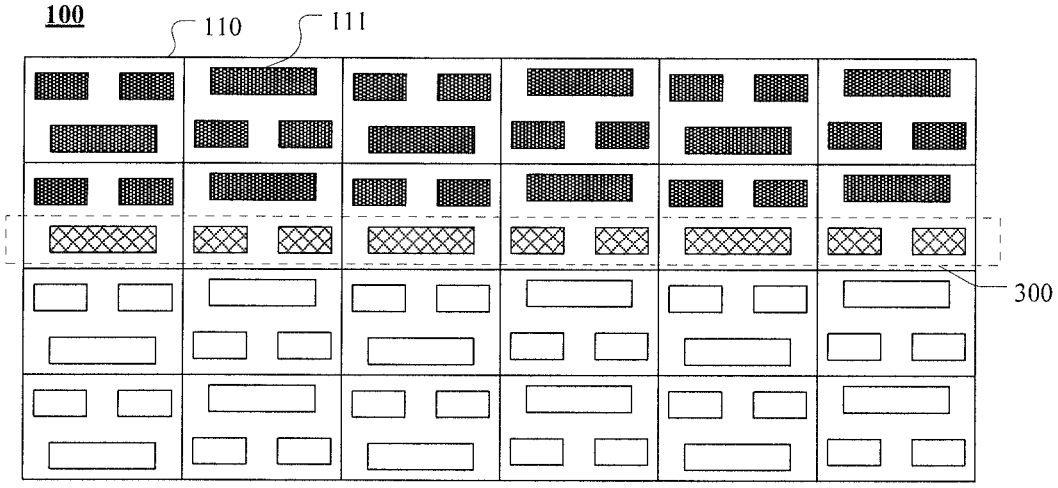
Fig. 3 (Prior Art)
FIG. 3 is a schematic diagram which shows displaying images after modifying brightness values of pixel points in a pixel array in conventional technologies.
Figure 4:
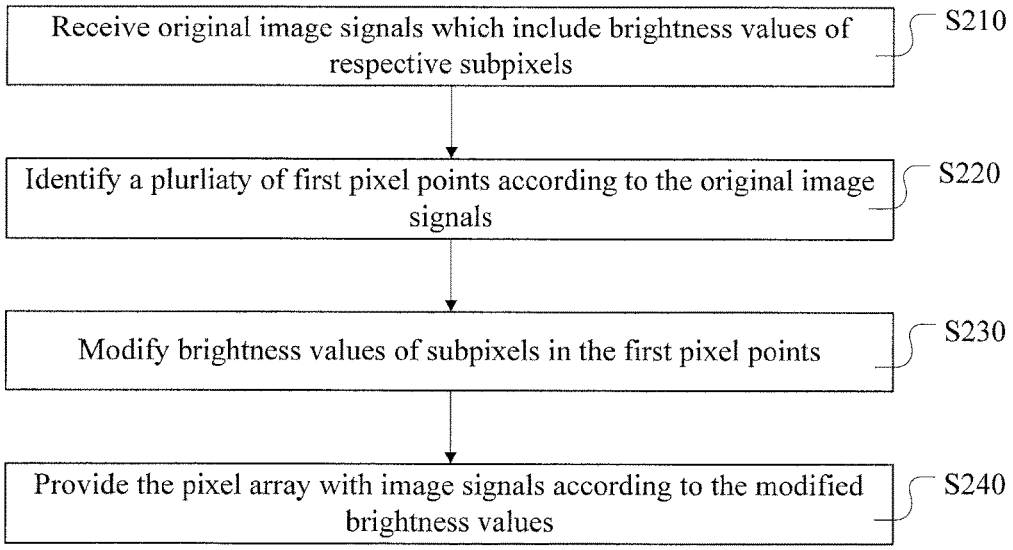
FIG. 4 is a flowchart showing a method for modifying image displaying on a display panel according to an embodiment of the present disclosure.

Now, exemplary implementations will be described more comprehensively with reference to the accompanying drawings. However, the exemplary implementations may be carried out in various manners, and shall not be interpreted as being limited to the implementations set forth herein; instead, providing these implementations will make the present disclosure more comprehensive and complete and will fully convey the conception of the exemplary implementations to the ordinary skills in this art. Throughout the drawings, the like reference numbers refer to the same or the like structures, and repeated descriptions will be omitted.

The features, structures or characteristics described herein may be combined in one or more embodiments in any suitable manner. In the following descriptions, many specific details are provided to facilitate sufficient understanding of the embodiments of the present disclosure. However, one of ordinary skills in this art will appreciate that the technical solutions in the present disclosure may be practiced without one or more of the specific details, or by employing other methods, components, materials and so on. In other conditions, well-known structures, materials or operations are not shown or described in detail so as to avoid confusion of respective aspects of the present disclosure.

The drawings of the present disclosure are only for illustrating relative position relationships, and the sizes of pixels and subpixels are shown exaggerated for convenience in understanding. However, the sizes in the drawings do not reflect real proportions of sizes.

In order to eliminate zigzags in images displayed using a pixel array which is arranged in a delta arrangement, the present disclosure provides a method for providing image signals to the pixel array. The method of the present disclosure will be described with reference to FIGS. 4 to 7.

The pixel array 100 provided by the present disclosure includes a plurality of pixel points 110. Optionally, respective pixel points 110 in the pixel array 100 are arranged in a matrix. That is, the plurality of pixel points 110 are aligned with each other in row and column directions. Each pixel point 110 includes three subpixels 111 of three different colors which are arranged in a delta arrangement.

Figure 5:
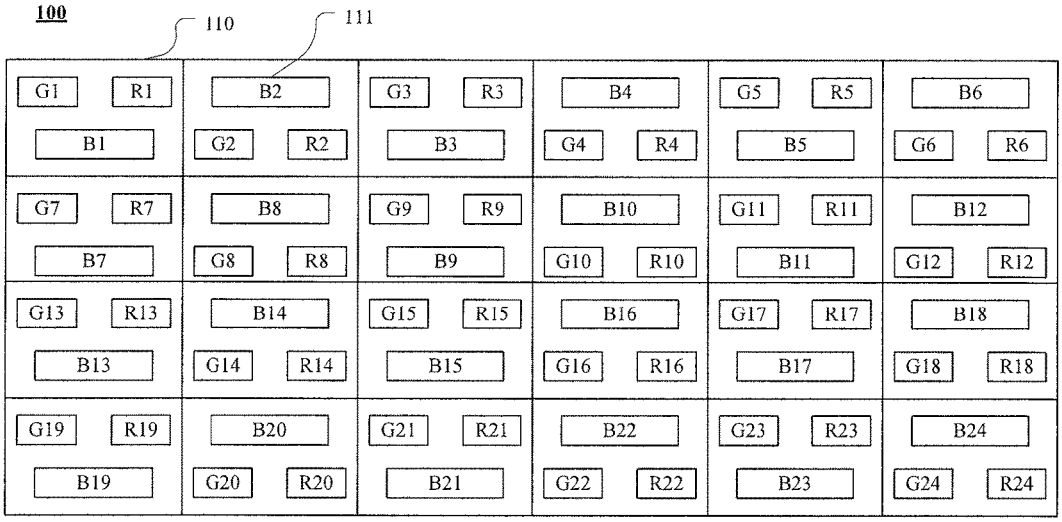
FIG. 5 is a schematic diagram showing a pixel array according to an embodiment of the present disclosure.

The three subpixels 111 of the three different colors which constitute one pixel point 110 are a red subpixel R, a green subpixel G and a blue subpixel B. In an embodiment, the subpixels 111 have a rectangular shape. In other embodiments, the subpixels 111 may have a circular shape, a triangular shape or other irregular shape. Optionally, in the embodiment, an area of each blue subpixel B is greater than either one of areas of each green subpixel G and red subpixel R. According to the subpixel arrangement provided by the present disclosure, any two adjacent subpixels 111 have different colors. For example, as shown in FIG. 5, subpixels G2, R2, R7, G8, R8 and G9 are adjacent to a blue subpixel B8, and these subpixels have a red or green color, which is different from the color of the blue subpixel B8. Subpixels R2, B3, B8, R8, B9 and R9 are adjacent to a green subpixel G9. These subpixels have a red or blue color, which is different from the color of the green subpixel G9.

Specifically, connection lines for connecting center points of the three subpixels 111 of three different colors which are arranged in a delta arrangement form a triangle which may be an acute triangle, a right triangle or an obtuse triangle, for example. The shape of the formed triangle may be dependent on the sizes of the subpixels 111 of different colors and distances between the subpixels 111. Further, in the embodiment, for two neighboring pixel points 111 in the row direction, the triangles formed by the connection lines for connecting the center points of the subpixels 111 in the two pixel points have opposite vertex orientations. For two neighboring pixel points 110 in the column direction, the triangles formed by the connection lines for connecting the center points of the subpixels 111 in the two pixel points have the same convex orientation. Specifically, a pixel point P1 is composed of a green subpixel G1, a red subpixel R1 and a blue subpixel B1. The vertex of a triangle formed by the connection lines for connecting the center points of the three subpixels faces the bottom. A pixel pint P2 which is adjacent to the pixel point P1 in the row direction, is composed of a green subpixel G2, a red subpixel R2 and a blue subpixel B2. The vertex of a triangle formed by the connection lines for connecting the center points of the three subpixels faces the top. That is, the vertex orientations of the two triangles are opposite. A pixel P7 which is adjacent to the pixel point P1 in the column direction, is composed of a green subpixel G7, a red subpixel R7 and a blue subpixel B7. The vertex of a triangle formed by the connection lines for connecting the center points of the three subpixels faces the bottom. That is, the vertex orientation of the triangle formed by the connection lines for connecting the center points of the three subpixels in the pixel point P7 is the same as that of the triangle formed by the connection lines for connecting the center points of the three subpixels in the pixel point P1.

According to such pixel array 100, the method for providing image signals to the pixel array 100 provided by the present disclosure includes the following steps.

In step S210, original image signals are received. The original image signals include brightness values of respective subpixels. Subpixels 111 of different colors at different positions in the pixel array 110 emit light according to different brightness values so that the pixel array 100 can display images.

In step S220, a plurality of first pixel points are determined.

Figure 6:
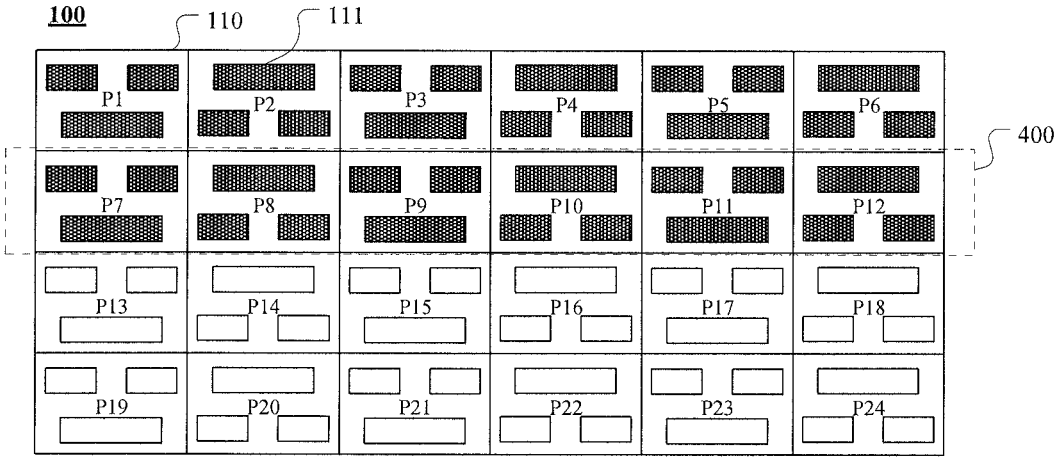
FIG. 6 is a schematic diagram which shows displaying original image signals using a pixel array according to an embodiment of the present disclosure.

In an embodiment, the first pixel points are pixel points which are located at edges of an object displayed according to the original image signals. In the embodiment, the edge pixel points of the object displayed according to the original image signals are identified in accordance with the original image signals, and the edge pixel points 110 at the edges of the object are taken as the first pixel points. As shown in FIG. 6, pixel points P7, P8, P9, P10, P11 and P12 in an edge 400 of an object (i.e., edge pixel points) serve as the first pixel points. Specifically, the difference between the brightness value of a subpixel in one first pixel point and the brightness value of a subpixel in a pixel point which is adjacent to the first pixel point but outside the edge of the object is greater than a preset threshold. For example, referring to FIG. 6 again, the difference between the brightness value of a subpixel in the first pixel point P7 and the brightness value of a subpixel in the pixel point P13 is greater than a preset threshold, and the pixel point 13 is adjacent to the first pixel point P7 but outside the edge 400 of the object. The difference between the brightness value of a subpixel in the first pixel point P8 and the brightness value of a subpixel in the pixel point P14 is greater than a preset threshold, and the pixel point 14 is adjacent to the first pixel point P8 but outside the edge 400 of the object. Further, the difference between brightness values of subpixels in the first pixel points in the edge 400 of the object is smaller than another preset threshold. In other words, there is a relatively big gap between the brightness values of a first pixel point and a pixel point which is adjacent to the first pixel point but outside the edge of the object, while there is a relatively small gap between the brightness values of first pixel points in the edge of the object. The present disclosure identifies the edge pixel points of the object to be displayed based on such principle.

In a modified embodiment, the subpixel points at both sides of the edge 400 of the object (for example, the subpixel points P7 and P13, and P8 and P14) can serve as the first pixel points. In another modified embodiment, each of the pixel point 110 in the pixel array 100 can serve as a first pixel point. As such, the step for identifying object edges can be omitted.

In step S230, for each subpixel in each of the first pixel points, the brightness value of the subpixel is modified according to the brightness value of a subpixel having the same color as the subpixel in at least one of pixel points which are adjacent to the first pixel point. Optionally, the present disclosure uses a low pass filter to modify the brightness value of subpixels in the first pixel points.

Specifically, for each subpixel in each of the first pixel points, the brightness value of the subpixel is modified according to the brightness value of a subpixel having the same color as the subpixel in at least one of pixel points which are adjacent to the first pixel point in the row and/or column direction. Referring to FIGS. 5 and 6, for example, for a red subpixel R8 in a first pixel point P8, the brightness value of the red subpixel R8 can be modified using the brightness value of a red subpixel R2 in a pixel point P2 which is adjacent to the first pixel point P8 in the column direction. As an example, for a red subpixel R8 in a first pixel point P8, the brightness value of the red subpixel R2 can be modified using the brightness value of a red subpixel R2 in a pixel point P2 which is adjacent to the first pixel point P8 in the column direction and the brightness value of a red subpixel R7 in a pixel point P7 which is adjacent to the pixel point P8 in the row direction. As another example, for a red subpixel R8 in a first pixel point P8, the brightness value of the red subpixel R8 can be modified using the brightness value of a red subpixel R7 in a pixel point P7 which is adjacent to the pixel point P8 in the row direction.

In a specific embodiment of the present disclosure, the brightness values of the three subpixels in a first pixel point can be modified differently. For example, for each subpixel having a first color in each of the first pixel points, the brightness value of the subpixel having the first color can be modified according to the brightness value of a subpixel having the first color in one pixel point which is immediately above and adjacent to the first pixel point in the column direction and the brightness value of a subpixel having the first color in one pixel point which is at immediate left of and adjacent to the first pixel point in the row direction. For each subpixel having a second color in each of the first pixel points, the brightness value of the subpixel having the second color can be modified according to the brightness value of a subpixel having the second color in one pixel point which is immediately above and adjacent to the first pixel point in the column direction and the brightness value of a subpixel having the second color in one pixel point which is at immediate right of and adjacent to the first pixel point in the row direction. For each subpixel having a third color in each of the first pixel points, the brightness value of the subpixel having the third color can be modified according to the brightness value of a subpixel having the third color in one pixel point which is immediately below the first pixel point in the column direction. Taking a first pixel point P9 as an example, the brightness values of the subpixels in the pixel point P9 can be modified based on the above method as follows:

Green subpixel $G9$: $g9'=g9*w_1+g3*w_2+g8*w_3$;

Red subpixel $R9$: $r9'=r9*w_4+r3*w_5+r10*w_6$;

Blue subpixel $B9$: $b9'=b9*w_7+b15*w_8$;

where g9' is a modified brightness value of the green subpixel G9; g9, g3, and g8 are brightness values of the green subpixel G9, G3 and G8; r9' is a modified brightness value of a red subpixel R9; r9, r3, and r10 are brightness values of the red subpixels R9, R3 and R10; b9' is a modified brightness value of a blue subpixel B9; b9 and b15 are brightness values of the blue subpixels B9 and B15; $w_1$ to $w_8$ are filter parameters of low pass filters. The filter parameters of the low pass filter can be adjusted according to the seizes of the subpixels and the distances between the subpixels. For example, the filter parameters can be set as follows: $w_1=0.75$, $w_2=0.25$, $w_3=0$, $w_4=0.75$, $w_5=0.25$, $w_6=0$, $w_7=0.75$, $w_8=0.25$. In a modified embodiment, the method for modifying the brightness value of the green subpixel and the method for modifying the brightness value of the red subpixel can be exchanged. For example:

$$g9'=g9*w_1+r3*w_2+r8*w_3;$$

$$g9'=g9*w_4+g3*w_5+g10*w_6.$$

In another embodiment of the present disclosure, for each subpixel having a first color in each of the first pixel points, the brightness value of the subpixel having the first color can be modified according to the brightness value of a subpixel having the first color in one pixel point which is immediately below and adjacent to the first pixel point in the column direction and the brightness value of a subpixel having the first color in one pixel point which is at immediate left of and adjacent to the first pixel point in the row direction. For each subpixel having a second color in each of the first pixel points, the brightness value of the subpixel having the second color can be modified according to the brightness value of a subpixel having the second color in one pixel point which is immediately below and adjacent to the first pixel point in the column direction and the brightness value of a subpixel having the second color in one pixel point which is at immediate right of and adjacent to the first pixel point in the row direction. For each subpixel having a third color in each of the first pixel points, the brightness value of the subpixel having the third color can be modified according to the brightness value of a subpixel having the third color in one pixel point which is immediately above the first pixel point in the column direction. Taking a first pixel point P8 as an example, the brightness values of the subpixels in the pixel point P8 can be modified based on the above method as follows:

Green subpixel $G8$: $g8'=g8*w_9+g14*w_{10}+g7*w_{11}$;

Red subpixel $R8$: $r8'=r8*w_{12}+r14*w_{13}+r9*w_{14}$;

Blue subpixel $B9$: $b8'=b8*w_{15}+b2*w_{16}$;

where g8' is a modified brightness value of the green subpixel G8; g8, g14, and g7 are brightness values of the green subpixel G8, G14 and G7; r8' is a modified brightness value of a red subpixel R8; r8, r14, and r9 are brightness values of the red subpixels R8, R14 and R9; b8' is a modified brightness value of a blue subpixel B8; b8 and b2 are brightness values of the blue subpixels B8 and B2; $w_9$ to $w_{16}$ are filter parameters of low pass filters. The filter parameters of the low pass filter can be adjusted according to the seizes of the subpixels and the distances between the subpixels. For example, the filter parameters can be set as follows: $w_9=0.75$, $w_{10}=0.25$, $w_{11}=0$, $w_{12}=0.75$, $w_{13}=0.25$, $w_{14}=0$, $w_{15}=0.75$, $w_{16}=0.25$. In a modified embodiment, the method for modifying the brightness value of the green subpixel and the method for modifying the brightness value of the red subpixel can be exchanged. For example:

$$r8'=r8*w_9+r14*w_{10}+r7*w_{11};$$

$$g8'=g8*w_{12}+g14*w_{13}+g9*w_{14}.$$

In another embodiment of the present disclosure, the above two modifying methods can be combined. For example, for the neighboring pixel points in the row direction, different modifying methods can be used; and, for the neighboring pixel points in the column direction, the same modifying method can be sued. For example, For a pixel point P8:

$$g8'=g8*w_9+g14*w_{10}+g7*w_{11};$$

$$r8'=r8*w_{12}+r14*w_{13}+r9*w_{14};$$

$$b8'=b8*w_{15}+b2*w_{16}.$$

For a pixel point P9 which is adjacent to the pixel point P8 in the row direction:

$$g9'=g9*w_1+g3*w_2+g8*w_3;$$

$$r9'=r9*w_4+r3*w_5+r10*w_6;$$

$$b9'=b9*w_7+b15*w_8.$$

For a pixel point P14 which is adjacent to the pixel point P8 in the column direction:

$$g14'=g14*w_9+g20*w_{10}+g13*w_{11};$$

$$r14'=r14*w_{12}+r20*w_{13}+r15*w_{14};$$

$$b14'=b14*w_{15}+b8*w_{16}.$$

In step 240, the pixel array is provided with modified image signals according to the modified brightness values of respective subpixels in the first pixel points.

Figure 7:
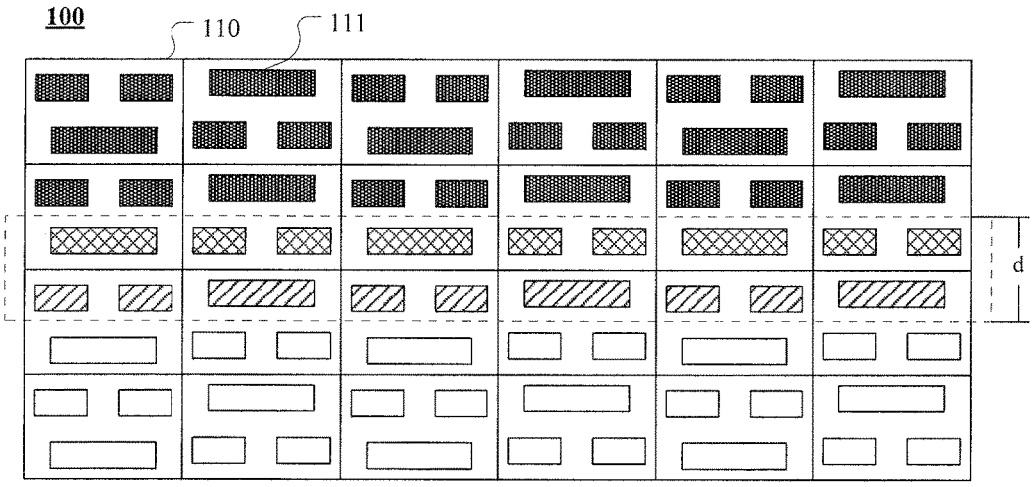
FIG. 7 is schematic diagram which shows displaying images after modifying brightness values using the pixel array according to an embodiment of the present disclosure.

The image displayed according to the modified brightness values is as shown in FIG. 7. As apparent from the figure, zigzags are removed from the image displayed using the pixel array in a delta arrangement. Meanwhile, the height d of the region at the edge of the object where the brightness values change gradiently equals to the height of one pixel point. Because of the height d of the region at the edge of the object where the brightness values change gradiently and the filter parameters, when modifying the image signals to be displayed using the modifying method of the present disclosure, even if the edges of the object to be displayed are white lines on a black background or black lines on a white background, the width of lines will not change.

Figure 8:
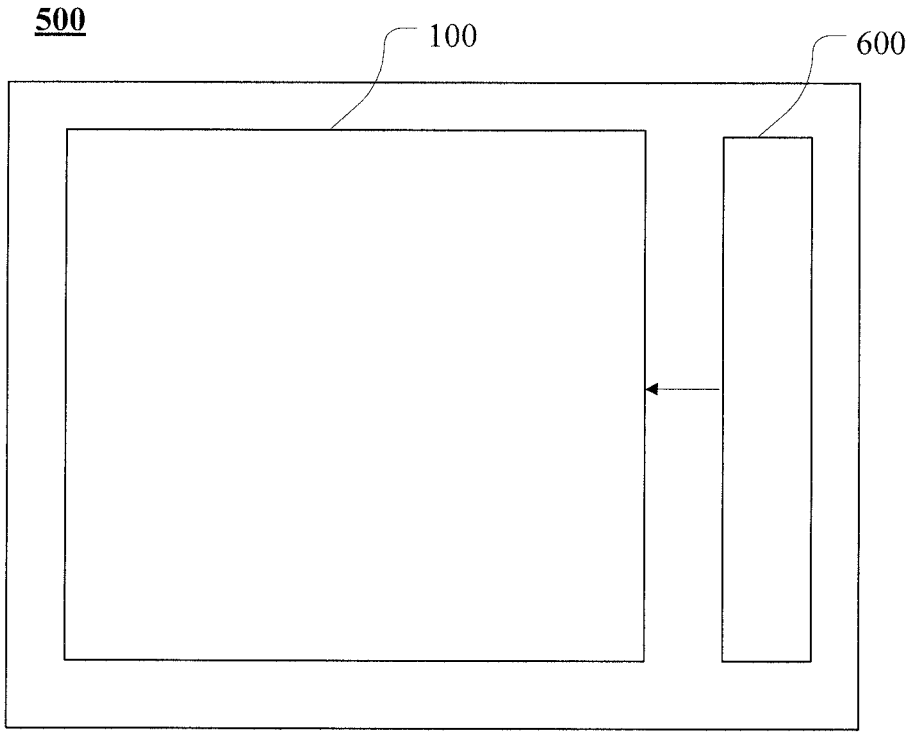
FIG. 8 is a schematic diagram showing a display device according to an embodiment of the present disclosure.

The present disclosure further provides a display panel. Referring to FIG. 8, the display panel 500 includes a pixel 100 and an image processing apparatus 600. Optionally, the display panel is an OLED display panel. The image processing apparatus 600 processes image signals using the above methods by a low pass filter and provides the modified image signals to the pixel array 100. Specifically, image processing apparatus 600 can be implemented as a device including a memory and an image processor. The memory can store instructions which can be executed by the image processor to perform the steps for processing image data. As an example, the image processing apparatus 600 can be implemented as an integrated circuit (IC). As another example, the image processing apparatus 600 can be incorporated into a data driver of the display panel, or may be a standalone device which is additionally provided in the display panel.

In the present disclosure, brightness values of subpixels are modified with a subpixel as a unit so as to eliminate the zigzags in images displayed using a pixel array in a delta arrangement. Meanwhile, the width of the region at edges of a displayed object where brightness values change gradiently can be reduced. If the edges of the object to be displayed are white lines on a black background or black lines on a white background, by modifying the brightness values of subpixels using the method provided by the present disclosure, the line widths will not change.

The above detailed descriptions relate to some possible implementations of the present disclosure, and however they are not for limiting the protection scope of the present disclosure, and any equivalent implementations or modifications without departing the spirit of the present disclosure shall fall within the protection scope of the present disclosure.

What is claimed is:

1. A method for modifying image displaying on a display panel, wherein the display panel comprises a pixel array composed of a plurality of pixel points each comprising three subpixels of three different colors which are arranged in a delta arrangement, wherein the method comprises:

receiving original image signals which comprise brightness values of respective subpixels;

according to the original image signals, identifying edge pixel points of an object to be displayed on the display panel as the first pixel points;

for each subpixel in each of the first pixel points, modifying the brightness value of the subpixel according to the brightness value of a subpixel having the same color as the subpixel in at least one of pixel points which are adjacent to the first pixel point; and providing the pixel array with modified image signals according to the modified brightness values of respective subpixels in the first pixel points;

wherein the brightness values of respective subpixels in the first pixel points are modified using a low pass filter, and parameters of the low pass filter are dependent on a size of each subpixel and distances between subpixels.

2. The method according to claim 1, wherein the plurality of pixel points are arranged in a row direction and a column direction, and any two adjacent subpixels have different colors.

3. The method according to claim 2, wherein, for each subpixel in each of the first pixel points, the brightness value of the subpixel is modified according to the brightness value of a subpixel having the same color as the subpixel in at least one of pixel points which are adjacent to the first pixel point in the row and/or column direction.

4. The method according to claim 3, wherein the modifying comprises:

modifying the brightness value of each subpixel in the first pixel points using a first brightness modifying method; or modifying the brightness value of each subpixel in the first pixel points using a second brightness modifying method; or for any two first pixel points which are adjacent with each other in the row direction, modifying the brightness value of each subpixel in one of the two pixel points using the first brightness modifying method, and modifying the brightness value of each subpixel in the other one of the two pixel points using the second brightness modifying method; and for any two first pixel points which are adjacent with each other in the column direction, modifying the brightness value of each subpixel in the two pixel points using the same brightness modifying method.

5. The method according to claim 4, wherein the first brightness modifying method comprises:

for each subpixel having a first color in each of the first pixel points, modifying the brightness value of the subpixel having the first color according to the brightness value of a subpixel having the first color in one pixel point which is immediately above and adjacent to the first pixel point in the column direction and the brightness value of a subpixel having the first color in one pixel point which is at immediate left of and adjacent to the first pixel point in the row direction;

for each subpixel having a second color in each of the first pixel points, modifying the brightness value of the subpixel having the second color according to the brightness value of a subpixel having the second color in one pixel point which is immediately above and adjacent to the first pixel point in the column direction and the brightness value of a subpixel having the second color in one pixel point which is at immediate right of and adjacent to the first pixel point in the row direction; and for each subpixel having a third color in each of the first pixel points, modifying the brightness value of the subpixel having the third color according to the brightness value of a subpixel having the third color in one pixel point which is immediately below the first pixel point in the column direction.

6. The method according to claim 5, wherein the first color, the second color, and the third color are green, red, and blue, respectively; or the first color, the second color, and the third color are red, green, and blue, respectively.

7. The method according to claim 6, wherein an area of each blue subpixel is greater than an area of either of each red subpixel and green subpixel.

8. The method according to claim 4, wherein the second brightness modifying method comprises:

for each subpixel having a first color in each of the first pixel points, modifying the brightness value of the subpixel having the first color according to the brightness value of a subpixel having the first color in one pixel point which is immediately below and adjacent to the first pixel point in the column direction and the brightness value of a subpixel having the first color in one pixel point which is at immediate left of and adjacent to the first pixel point in the row direction;

for each subpixel having a second color in each of the first pixel points, modifying the brightness value of the subpixel having the second color according to the brightness value of a subpixel having the second color in one pixel point which is immediately below and adjacent to the first pixel point in the column direction and the brightness value of a subpixel having the second color in one pixel point which is at immediate right of and adjacent to the first pixel point in the row direction; and for each subpixel having a third color in each of the first pixel points, modifying the brightness value of the subpixel having the third color according to the brightness value of a subpixel having the third color in one pixel point which is immediately above the first pixel point in the column direction.

9. A display device, comprising:

a display panel, comprising a pixel array composed of a plurality of pixel points each comprising three subpixels of three different colors which are arranged in a delta arrangement;

an image processing apparatus configured to:

receive original image signals which comprise brightness values of respective subpixels;

according to the original image signals, identify edge pixel points of an object to be displayed on the display panel as the first pixel points;

for each subpixel in each of the first pixel points, modify the brightness value of the subpixel according to the brightness value of a subpixel having the same color as the subpixel in at least one of pixel points which are adjacent to the first pixel point; and provide the pixel array with modified image signals according to the modified brightness values of respective subpixels in the first pixel points;

wherein the brightness values of respective subpixels in the first pixel points are modified using a low pass filter, and parameters of the low pass filter are dependent on a size of each subpixel and distances between subpixels.

10. The display device according to claim 9, wherein the display device is an OLED display device.

11. The display device according to claim 9, wherein the plurality of pixel points are arranged in a row direction and a column direction, and any two adjacent subpixels have different colors.

12. The display device according to claim 11, wherein for each subpixel in each of the first pixel points, the brightness value of the subpixel is modified according to the brightness value of a subpixel having the same color as the subpixel in at least one of pixel points which are adjacent to the first pixel point in the row and/or column direction.

13. The display device according to claim 12, wherein the image processing apparatus is configured to:

modify the brightness value of each subpixel in the first pixel points using a first brightness modifying method; or modify the brightness value of each subpixel in the first pixel points using a second brightness modifying method; or for any two first pixel points which are adjacent with each other in the row direction, modify the brightness value of each subpixel in one of the two pixel points using the first brightness modifying method, and modify the brightness value of each subpixel in the other one of the two pixel points using the second brightness modifying method; and for any two first pixel points which are adjacent with each other in the column direction, modify the brightness value of each subpixel in the two pixel points using the same brightness modifying method.

14. The display panel according to claim 13, wherein the image processing apparatus is configured to:

for each subpixel having a first color in each of the first pixel points, modify the brightness value of the subpixel having the first color according to the brightness value of a subpixel having the first color in one pixel point which is immediately above and adjacent to the first pixel point in the column direction and the brightness value of a subpixel having the first color in one pixel point which is at immediate left of and adjacent to the first pixel point in the row direction;

for each subpixel having a second color in each of the first pixel points, modify the brightness value of the subpixel having the second color according to the brightness value of a subpixel having the second color in one pixel point which is immediately above and adjacent to the first pixel point in the column direction and the brightness value of a subpixel having the second color in one pixel point which is at immediate right of and adjacent to the first pixel point in the row direction; and for each subpixel having a third color in each of the first pixel points, modify the brightness value of the subpixel having the third color according to the brightness value of a subpixel having the third color in one pixel point which is immediately below the first pixel point in the column direction.

15. The display device according to claim 14, wherein the first color, the second color, and the third color are green, red, and blue, respectively; or the first color, the second color, and the third color are red, green, and blue, respectively.

16. The display device according to claim 15, wherein an area of each blue subpixel is greater than an area of either of each red subpixel and green subpixel.

17. The display device according to claim 13, wherein the image processing apparatus is configured to:

for each subpixel having a first color in each of the first pixel points, modify the brightness value of the subpixel having the first color according to the brightness value of a subpixel having the first color in one pixel point which is immediately below and adjacent to the first pixel point in the column direction and the brightness value of a subpixel having the first color in one pixel point which is at immediate left of and adjacent to the first pixel point in the row direction;

for each subpixel having a second color in each of the first pixel points, modify the brightness value of the subpixel having the second color according to the brightness value of a subpixel having the second color in one pixel point which is immediately below and adjacent to the first pixel point in the column direction and the brightness value of a subpixel having the second color in one pixel point which is at immediate right of and adjacent to the first pixel point in the row direction; and for each subpixel having a third color in each of the first pixel points, modify the brightness value of the subpixel having the third color according to the brightness value of a subpixel having the third color in one pixel point which is immediately above the first pixel point in the column direction.

* * * * *